US006267129B1

(12) United States Patent
Zheng

(10) Patent No.: US 6,267,129 B1
(45) Date of Patent: Jul. 31, 2001

(54) COLLAPSIBLE FRAME ASSEMBLIES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 09/379,029

(22) Filed: Aug. 23, 1999

(51) Int. Cl.[7] ..... E04H 15/40
(52) U.S. Cl. ..... 135/126
(58) Field of Search ..... 135/124, 125, 135/126, 117, 130, 143, 137, 128; 52/645, 656.1

(56) References Cited

U.S. PATENT DOCUMENTS 5,038,812 * 8/1991 Norman ..... 135/126
5,163,461 * 11/1992 Ivanovich et al. ..... 135/126
5,301,705 4/1994 Zheng .
5,467,794 * 11/1995 Zheng ..... 135/125
5,560,385 10/1996 Zheng ..... 135/125

FOREIGN PATENT DOCUMENTS 0902137 3/1999 (EP) .
2635136 * 2/1990 (FR) ..... 135/126
WO 90/15209 * 12/1990 (WO) ..... 135/125

* cited by examiner

*Primary Examiner*—Peter M. Cuomo
*Assistant Examiner*—James O. Hansen
(74) *Attorney, Agent, or Firm*—Raymond Sun

(57) ABSTRACT

A collapsible frame assembly has a coilable frame member having a folded and an unfolded orientation, and a plurality of corner sleeves. Each corner sleeve has a lumen for retaining a selected portion of the frame member, with the plurality of corner sleeves positioned in spaced apart relation along the frame member to form a bend at each location of a corner sleeve. Each collapsible frame assembly can be used to form a panel for a collapsible structure, with one side of each frame assembly hingedly coupled to another side of an adjacent frame assembly to form a series or ring of two or more frame assemblies.

15 Claims, 14 Drawing Sheets

COLLAPSIBLE FRAME ASSEMBLIES

BACKGROUND OF THE INVENTION

1. Field of the Invention

The present invention relates to collapsible structures, and in particular, to collapsible frame assemblies that can be used in supporting collapsible structures. The collapsible frame assemblies may be twisted and folded to reduce the overall size of the resulting collapsible structures to facilitate convenient storage and use.

2. Description of the Prior Art

Collapsible structures have recently become popular with both adults and children alike. Examples of such structures are shown and described in U.S. Pat. No. 5,038,812 (Norman), U.S. Pat. No. 5,467,794 (Zheng) and U.S. Pat. No. 5,560,385 (Zheng). These structures have a plurality of panels that may be twisted and folded to reduce the overall size of the structures to facilitate convenient storage and use. As such, these structures are being enjoyed by many people in many different applications.

The wide-ranging uses for these collapsible structures can be attributed to the performace, convenience and variety that these structures provide. These collapsible structures are made up of a plurality of panels, each of which is supported by a coilable frame member. When fully expanded, these structures are stable and can be used as a true shelter without the fear of collapse. The coilable frame members allow these structures to be easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

The coilable frame members for these collapsible structures are often made from either a continuous frame member formed into a loop, or an elongated frame member having its opposite ends secured together to form a continuous loop. These frame members define the shape of the panels, and provide the requisite support to maintain the panels in their defined shape.

In this regard, many of the known coilable frame members are typically provided in a pre-formed configuration which cannot be changed. As a result, the variety of use and play for the resulting collapsible structures can be limited.

Thus, there still remains a need for coilable frame members that allow different collapsible structures to be assembled that provide increased variety of play, entertainment value, and utility.

SUMMARY OF THE DISCLOSURE

In order to accomplish the objects of the present invention, the present invention provides a collapsible frame assembly having a coilable frame member having a folded and an unfolded orientation, and a plurality of corner sleeves. Each corner sleeve has a lumen for retaining a selected portion of the frame member, with the plurality of corner sleeves positioned in spaced apart relation along the frame member to form a bend at each location of a corner sleeve.

Each collapsible frame assembly can be used to form a panel for a collapsible structure, with one side of each frame assembly hingedly coupled to another side of an adjacent frame assembly to form a series or ring of two or more frame assemblies.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides coilable frame assemblies that can be formed of different shapes and sizes. These frame assemblies can be used to form and define panels that are assembled together to form collapsible structures. These structures can be folded and collapsed into a compact configuration for convenient storage and transportation.

Figure 1:
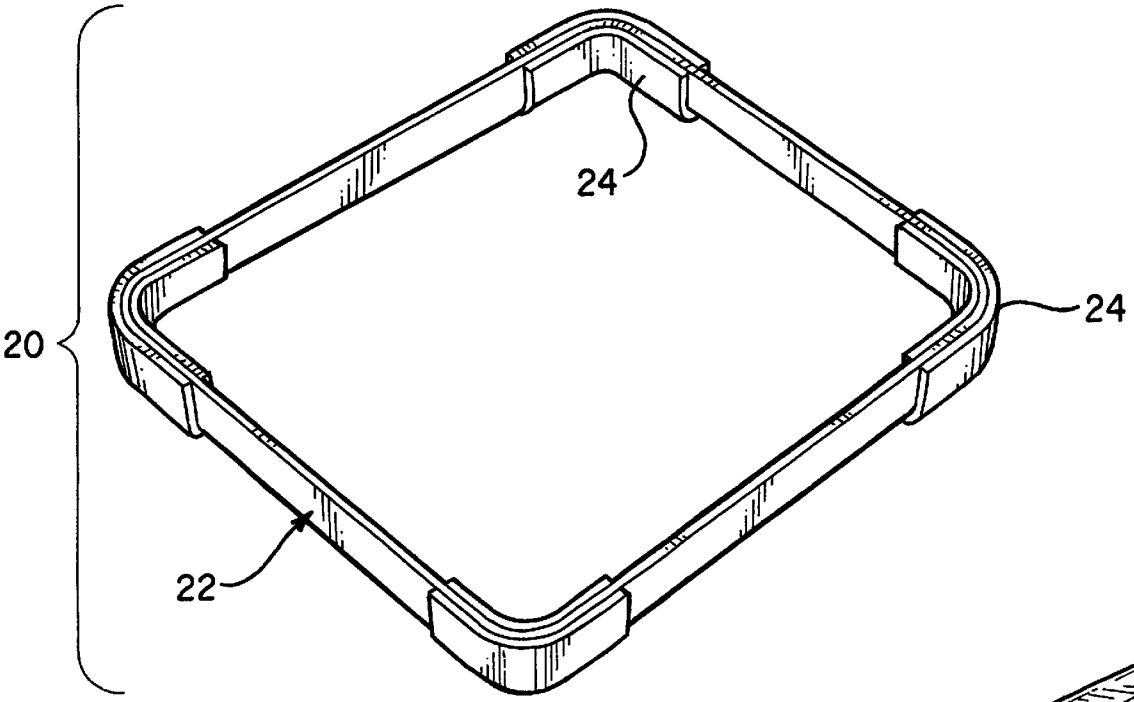
FIG. 1 is a perspective cut-away view of a frame assembly according to one embodiment of the present invention.
Figure 2:
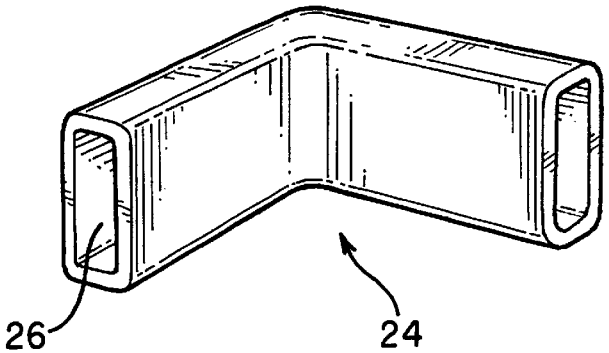
FIG. 2 is a perspective view of a corner sleeve of the frame assembly of FIG. 1.

FIGS. 1 and 2 illustrate a possible basic embodiment for a coilable frame assembly according to the present invention. The coilable frame assembly 20 has a frame member 22 and a plurality of corner sleeves 24 that receive selected portions of the frame member 22. Each sleeve 24 is generally tubular and defines a lumen 26 for receiving a portion of the frame member 22. FIG. 1 illustrates the frame assembly 20 in a cut-away view so that the frame member 22 can be shown lying inside the lumens 26 of the sleeves 24. Each sleeve 24 should be made of a flexible material that allows it to be twisted and folded together with the frame member 22. In particular, each sleeve 24 is made of a material that can be either flexible or stiff (depending on the application or intended use of the assembly 20), and the material can even have a memory. Examples of such materials can include plastic, PVC, rubber, and the like. Each sleeve 24 is also angled so as to define bends in the frame member 22 at the portions where the sleeve 24 is deployed.

In the embodiment of FIGS. 1 and 2, four sleeves 24 are provided to define a generally four-sided configuration for the frame assembly 20. Therefore, each sleeve 24 in FIGS. 1 and 2 functions to cause a selected portion of the frame member 22 to be bent or angled, and in this case, by about ninety degrees, to form a corner. As illustrated in other embodiments herein, the number of sleeves 24 can be varied to provide frame assemblies having a different number of sides. In addition, the shapes (i.e., angles) of the sleeves 24 can be varied to provide different shapes for the resulting frame assembly 20.

The frame member 22 may be provided as one continuous loop, or may comprise a strip of material connected at both ends to form a continuous loop. The frame member 22 is preferably formed of flexible coilable steel having a memory, although other materials such as plastics may also be used. The frame member 22 should be made of a material which is relatively strong and yet is flexible to a sufficient degree to allow it to be coiled. Thus, the frame member 22 is capable of assuming two positions or orientations, an open or expanded position such as shown in FIG. 1, or a folded position in which the frame member 22 is collapsed into a size which is much smaller than its open position (see FIG. 4F).

Figure 3:
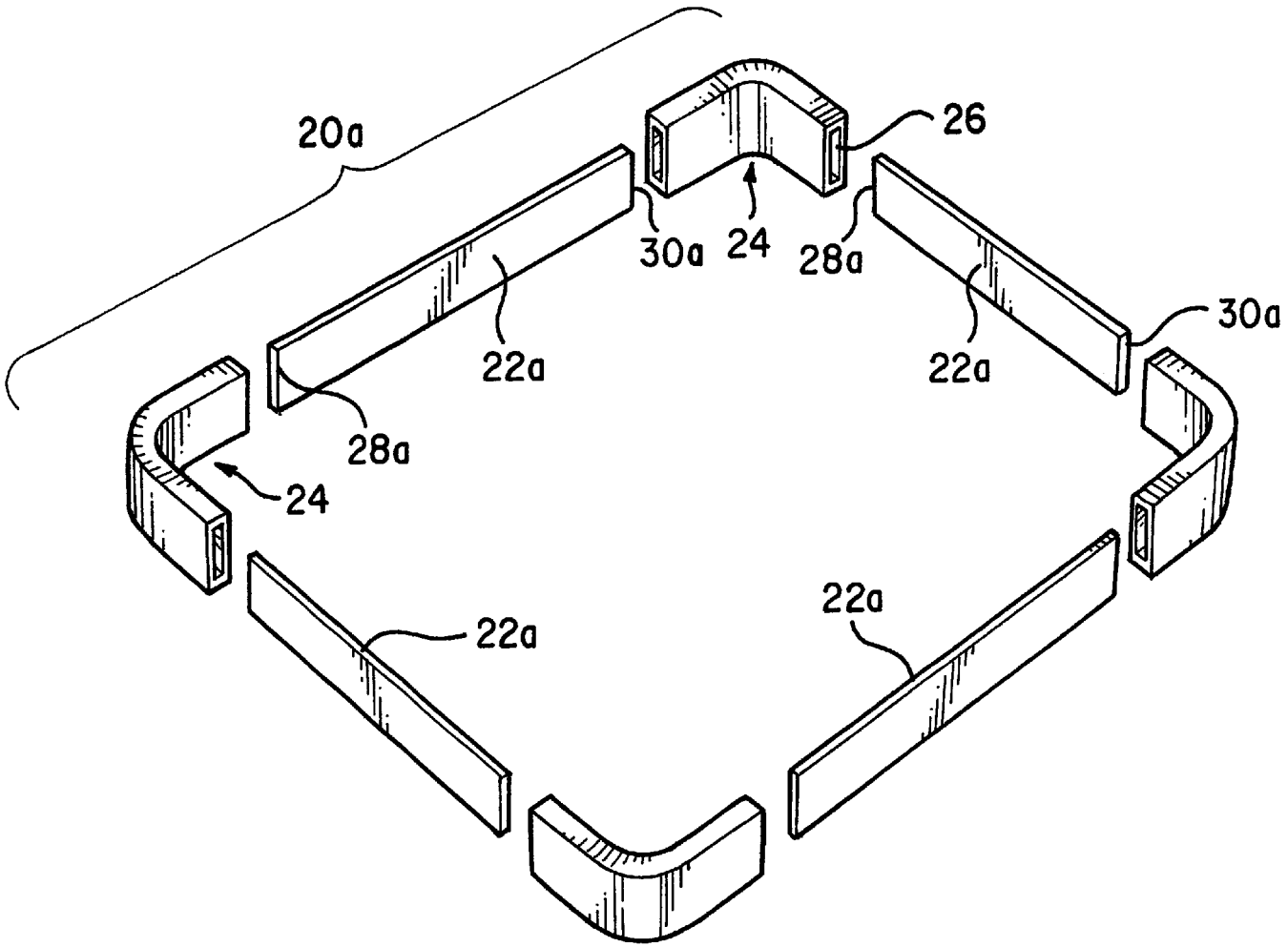
FIG. 3 is an exploded perspective view of a frame assembly according to another embodiment of the present invention.

FIG. 3 illustrates a modification to the frame assembly 20. In frame assembly 20*a* in FIG. 3, the sleeves 24 are still the same, but the singular frame member 22 has been replaced by a plurality of elongated frame members or sections 22*a*. Each opposing end 28*a* and 30*a* of each elongated section 22*a* is inserted into the lumen 26 of a different sleeve 24 and retained therein. The ends 28*a* and 30*a* can be secured inside the lumens 26 of the sleeves 24 by friction fit, glue, driving a nail or similar mechanism through the sleeve 24 and the end 28*a* or 30*a*, or similar methods. Thus, in addition to defining bends or corners, each sleeve 24 performs the additional function in the embodiment of FIG. 3 of connecting the ends 28*a* and 30*a* of two separate but adjacent elongated sections 22*a*. The elongated sections 22*a* can be made from the same material as the frame member 22.

Notwithstanding the different structures for the frame members 22 and 22*a*, each frame assembly 20 and 20*a* can be used to form a panel that can be combined with other panels to form a collapsible structure. Therefore, even though the numeral designation 20 will be used to designate frame assemblies hereinbelow, it is intended that this numeral designation can be applicable to either of the frame assemblies 20 and 20*a*.

Figure 4A:
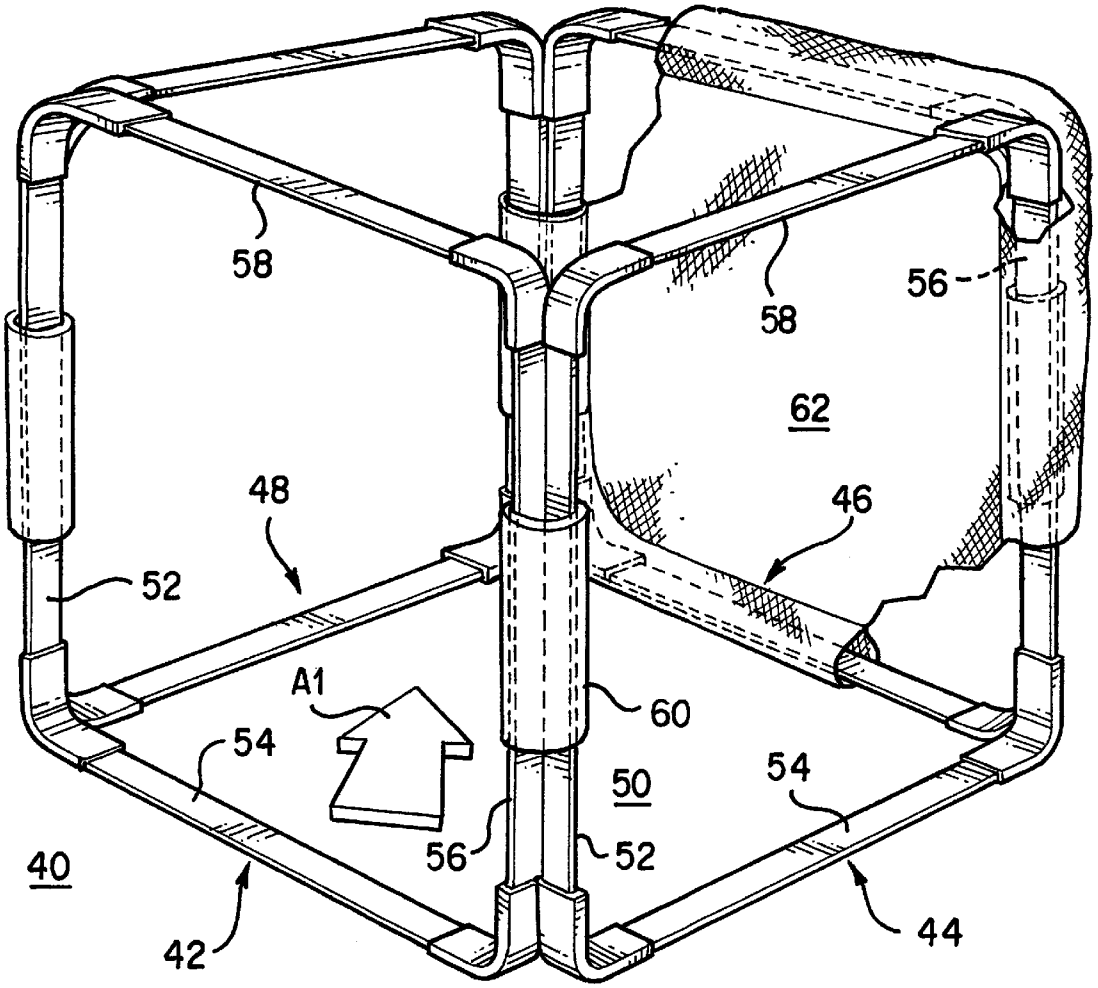
FIG. 4A is a perspective view of a structure formed from a plurality of the frame assemblies of the present invention.
Figure 4B:
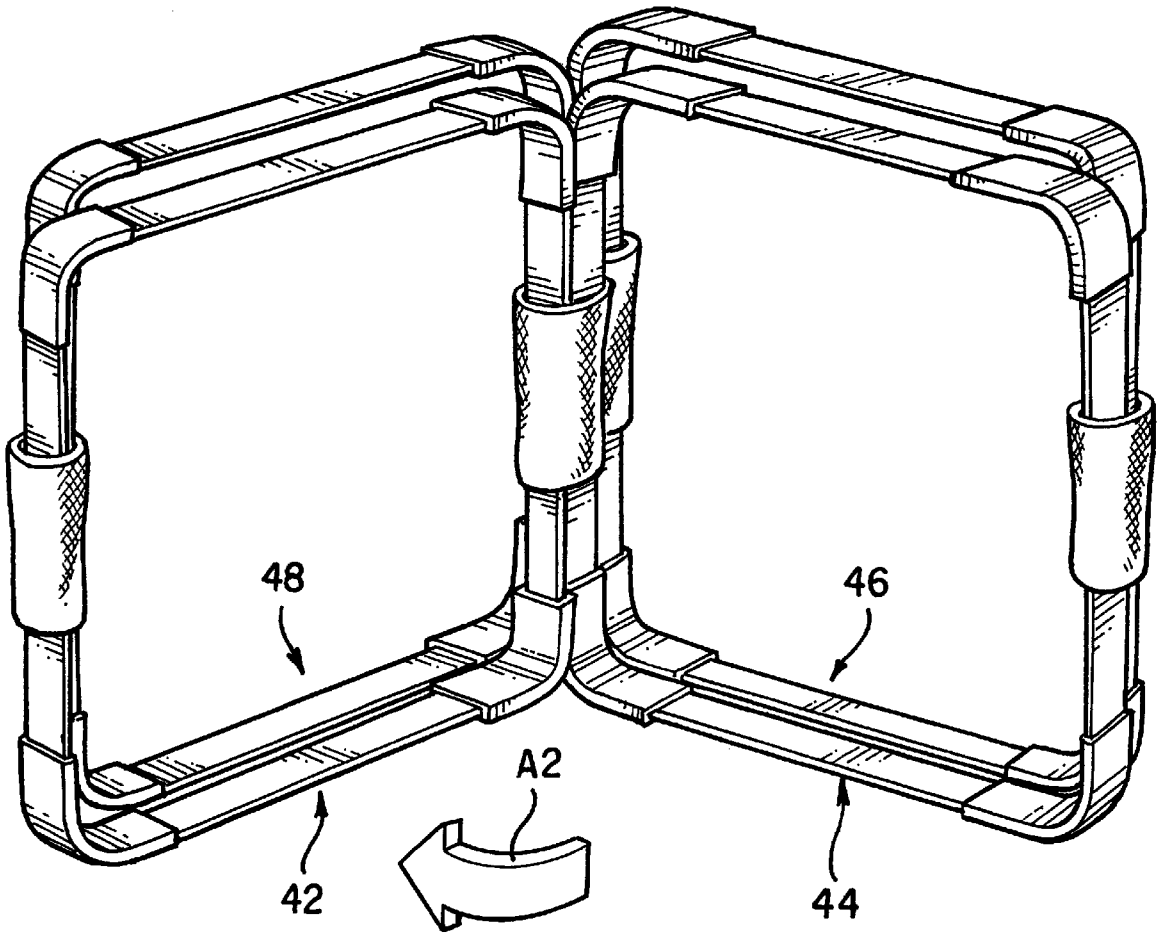
FIGS. 4B through 4F illustrate how the structure of FIG. 4A may be twisted and folded for compact storage.

One example of a collapsible structure 40 that utilizes a plurality of frame assemblies 20 is illustrated in FIG. 4A. Structure 40 has four panels 42, 44, 46, 48 that are coupled together to form an enclosed space 50. Each of these panels 42, 44, 46, 48 is defined by a frame assembly 20, and each panel 42, 44, 46, 48 has four sides 52, 54, 56, 58. The right side 56 of each panel (e.g., see panel 42) is hingedly connected to the left side 52 of an adjacent panel (e.g., see panel 44) by a retaining sleeve 60, which has a lumen that retains the two adjacent frame members 22 of the adjacent panels (e.g., 42 and 44). As a result of this hinged connection, adjacent panels can be folded about the hinge formed by the retaining sleeve 60. The retaining sleeve 60 can be made of a fabric or any of the materials used for the sleeves 24.

Fabric or sheet material 62 can extend across any of the panels 42, 44, 46, 48. For illustrative purposes only, a portion of one of the panels 46 is shown with a fabric 62, although it is possible to provide fabric material 62 to extend across any or all of the other panels 42, 44 and 48. The fabric 62 is held taut by the frame member 22 when in its open position. The fabric 62 can extend completely across the panel 46 to entirely cover the enclosed space defined by the frame member 22, or can extend across selected portions of the enclosed space defined by the frame member 22. The term fabric is to be given its broadest meaning and should be made from strong, lightweight materials and may include woven fabrics, sheet fabrics or even films. The fabric 62 should be water-resistant and durable to withstand wear and tear. The type of material used for the fabric 62 can be varied depending on the intended use. As one non-limiting example, a tough film-like material can be used if the panel 62 is intended for outdoor use or for use that may involve significant wear and tear. As another non-limiting example, a cloth-like material can be used if the structure 40 is intended primarily for indoor use.

Figure 11:
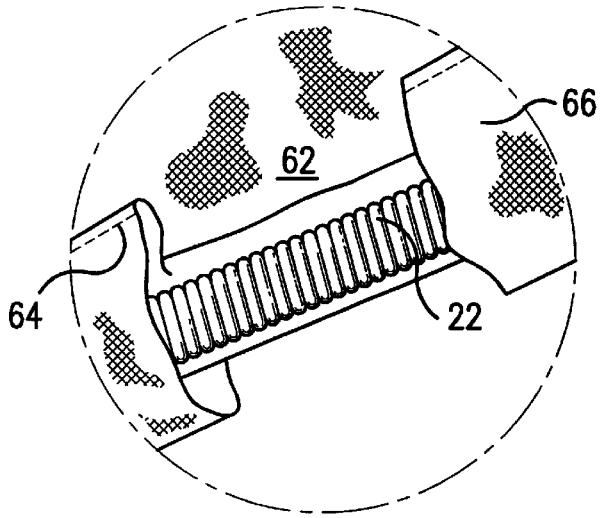
FIG. 11 is a partial cut-away view of the section A of the structure of FIG. 4A illustrating a frame member retained within a sleeve.

Referring to FIG. 11, the fabric piece 62 is stitched at its edges by a stitching 64 to a peripheral sleeve 66. The peripheral sleeve 66 may be formed by folding a piece of fabric, and then applying the stitching 64 to connect the peripheral sleeve 66 to the fabric. Alternatively, the peripheral sleeve 66 may be formed by merely folding over the fabric 62 and applying the stitching 64. The frame member 22 and the sleeves 24 may be merely retained within the peripheral sleeve 66 without being connected thereto. Alternatively, the peripheral sleeve 66 may be mechanically fastened, stitched, fused, or glued to the frame member 22 and sleeves 24 to retain them in position.

Figure 4C:
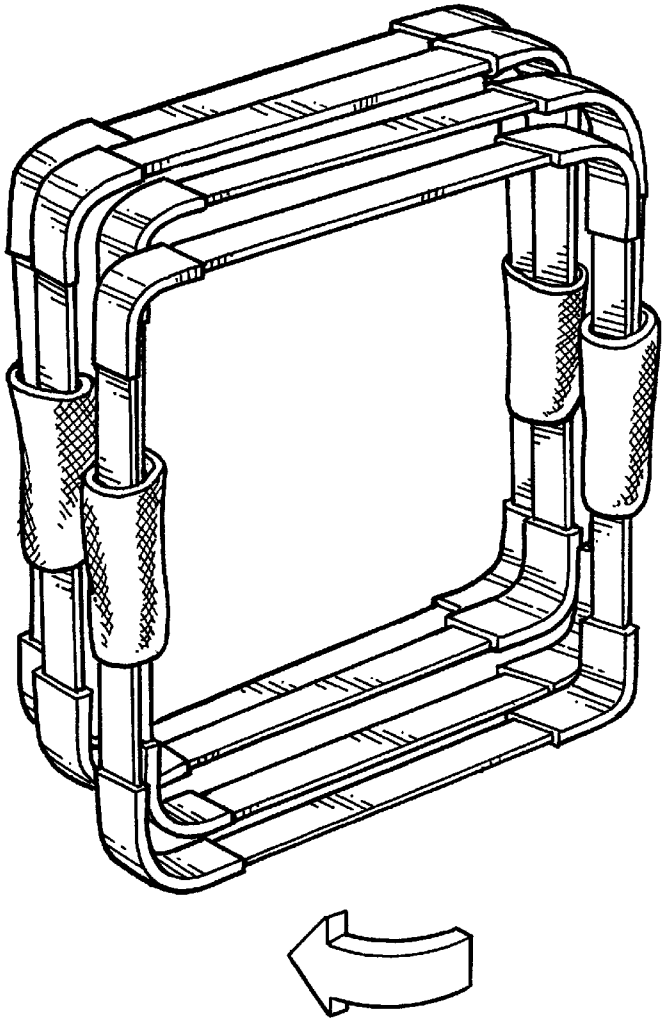
Figure 4D:
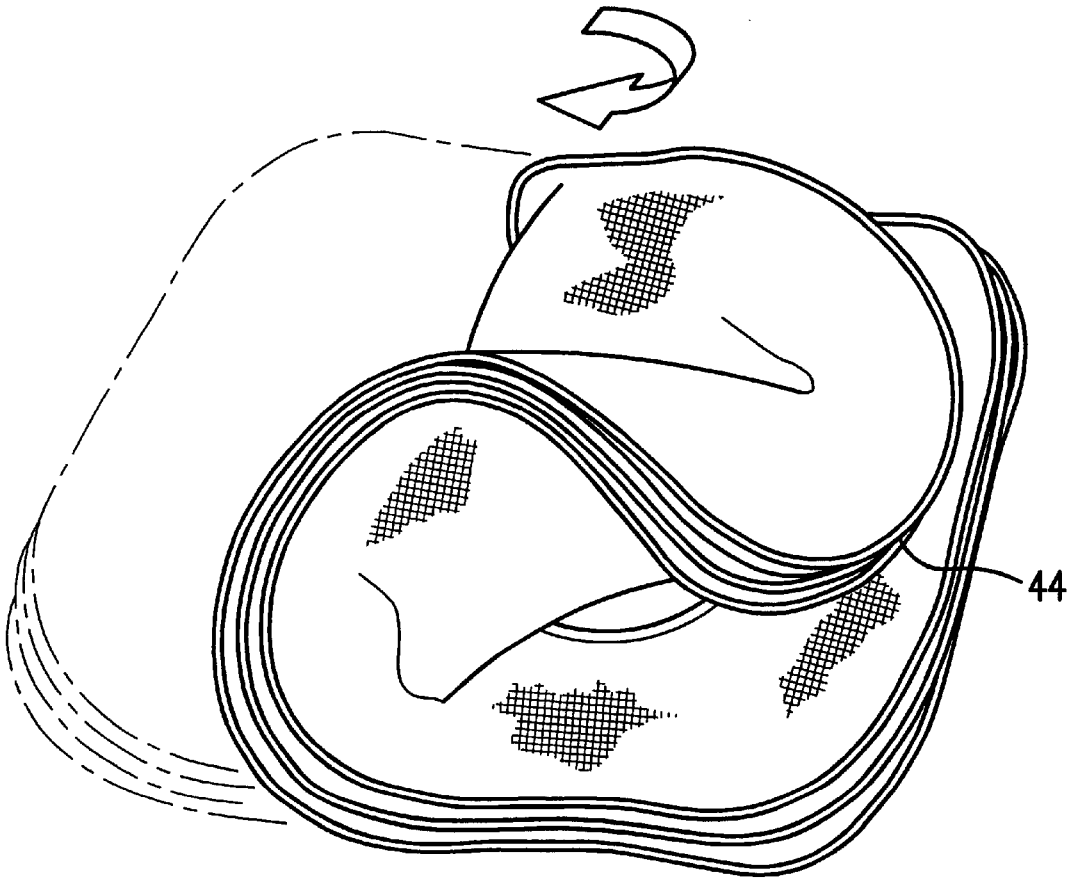
Figure 4E:
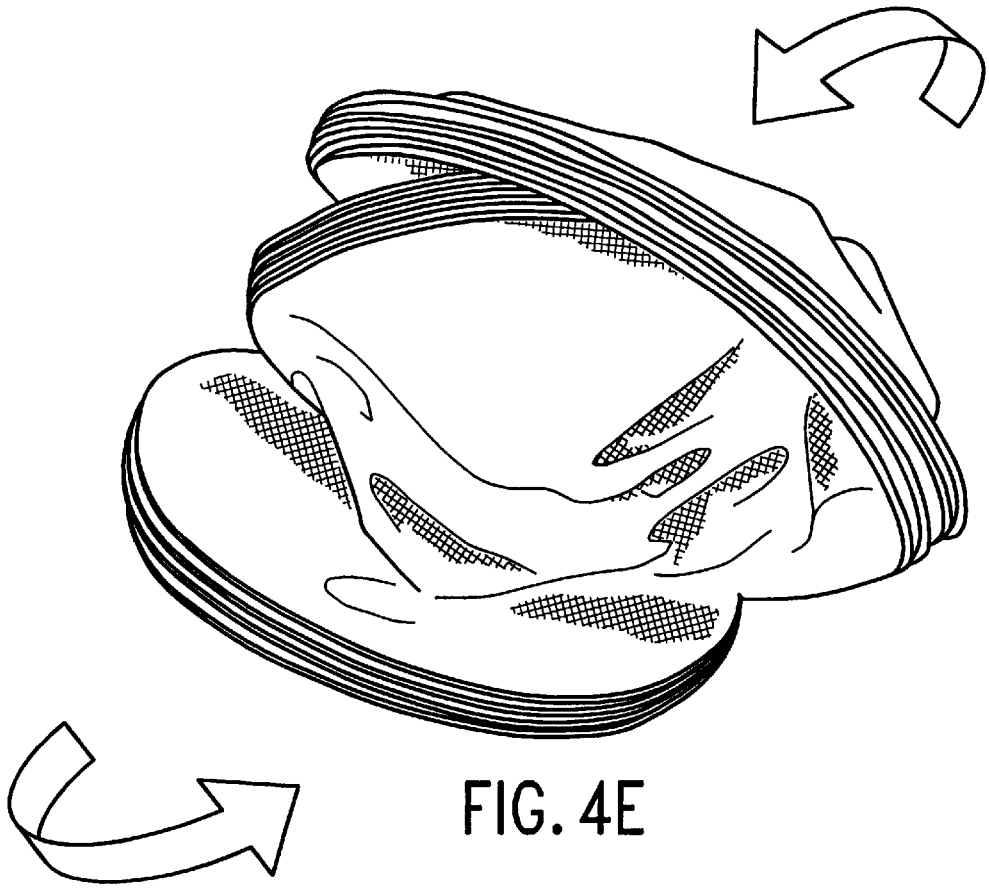
Figure 4F:
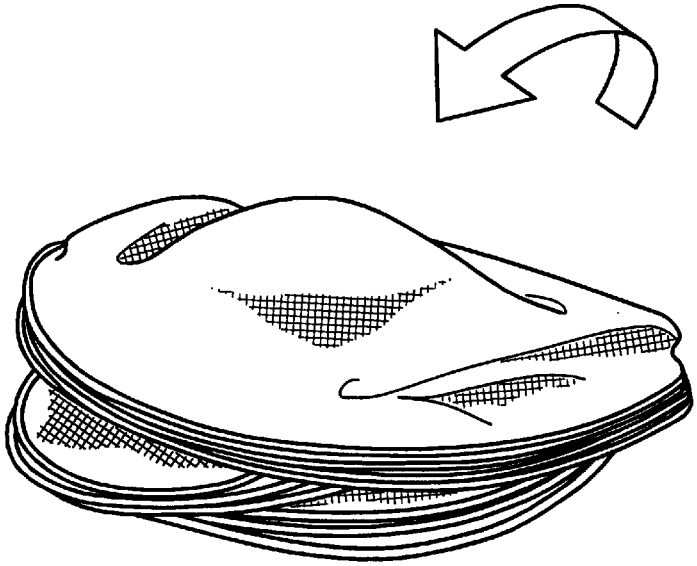

FIGS. 4A–4F describe the various steps for folding and collapsing the structure 40 of FIG. 4A for storage. In FIG. 4A, the panels 42 and 44 are pushed in against panels 48 and 46, respectively, about the hinges, in the direction of arrow A1. Then, the combined panels 44 and 46 are folded against the combined panels 42 and 48 about the hinges, in the direction of arrow A2 (see FIG. 4B) to form one stack of panels 46, 44, 42, 48, in one possible order, as shown in FIG. 4C. Thereafter, one opposing side or border of the combined panels 42, 44, 46, 48 is folded in to collapse the frame members 22 with the panels 42, 44, 46, 48. As shown in FIGS. 4D–4F, the panels are twisted and folded to continue the collapsing so that the initial size of the panels is reduced. FIG. 4F shows the frame members 22 and panels collapsed on each other to provide for a small essentially compact configuration having a plurality of concentric frame members 22 and panels so that the collapsed structure 40 has a size which is a fraction of the size of the initial structure 40 in the expanded upstanding configuration.

To re-open the structure 40 to its expanded configuration, the panels 42, 44, 46, 48 are unfolded. The memory (i.e., spring-load) of the frame members 22 will cause the frame members 22 to uncoil on their own and to quickly expand the panels 42, 44, 46, 48 to their expanded configuration shown in FIG. 4C. The respective panels 42, 44, 46, 48 can then be folded about their hinged connections to be opened. The same principles can be applied to collapse, and to re-open, all the other embodiments of the present invention described above. In addition, the frame assemblies 20, 20*a*, 20*b*, 80, 90 of FIGS. 1, 3, 6, 7 and 8, respectively, can be collapsed according to the steps shown in FIGS. 4D–4F.

Figure 5:
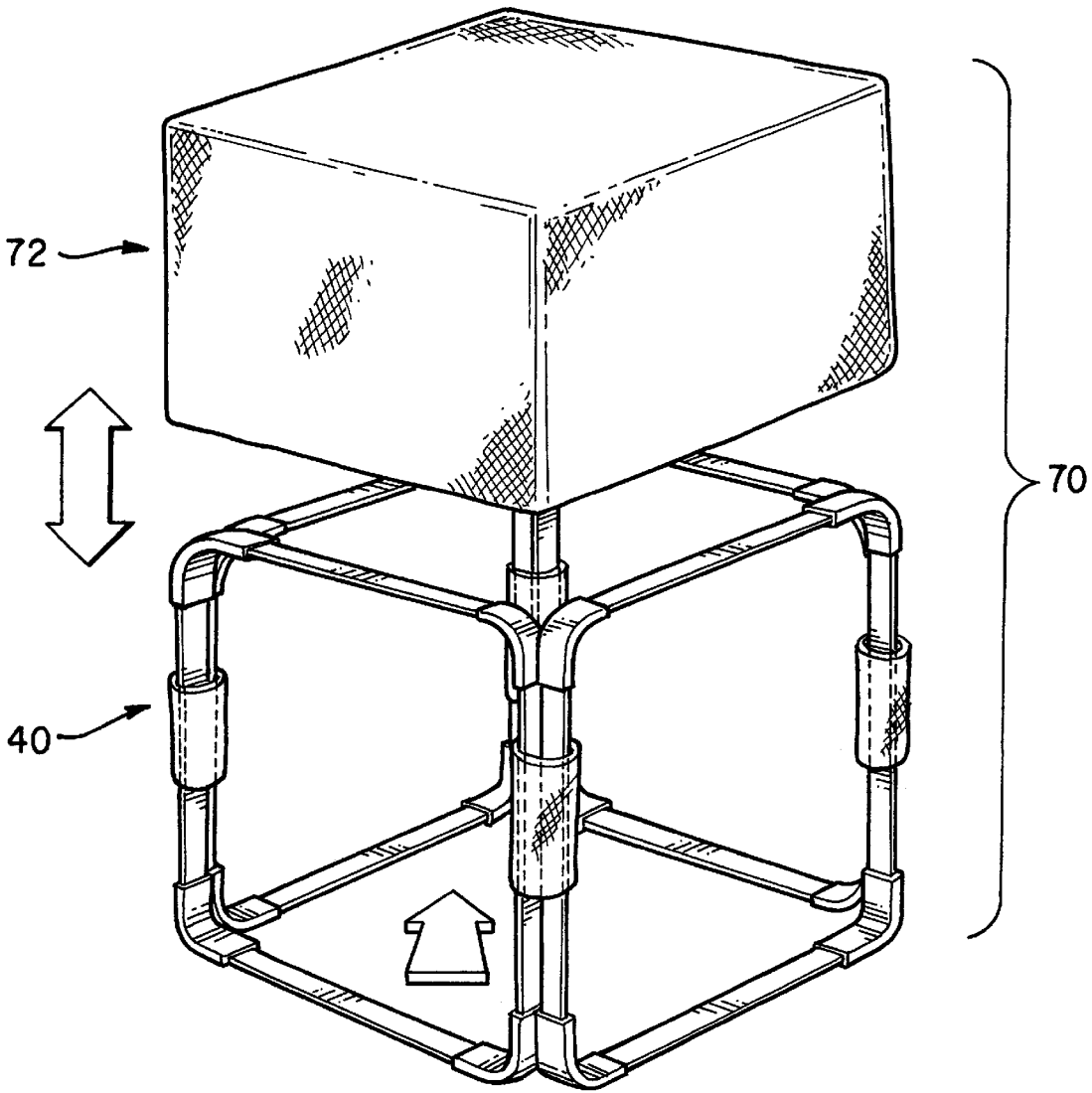
FIG. 5 illustrates how a cover can be applied to the structure of FIG. 4A.

FIG. 5 illustrates a structure 70 in which the frame assemblies in FIG. 4A are used as a support for a fabric covering 72. The fabric covering 72 can be a four-sided enclosing fabric piece, with each side having generally the same shape and size as one of the frame assemblies 20 that make up the panels 42, 44, 46, 48. The covering 72 can then be slipped over the structure 40 to encircle or enclose the structure 40, as shown in FIG. 5.

Figure 6:
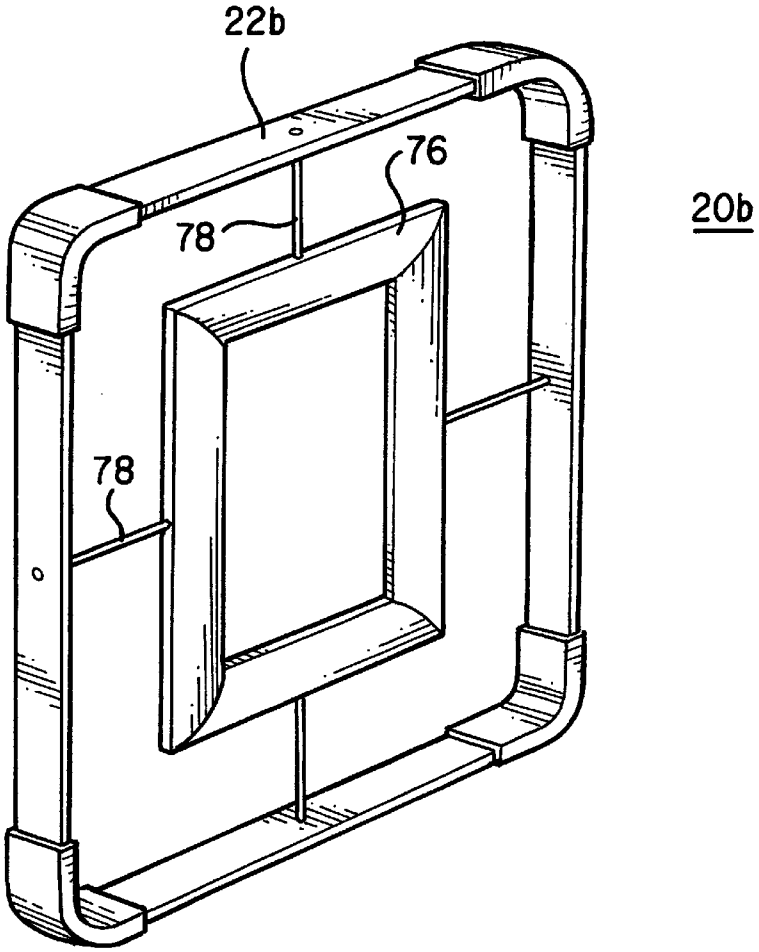
FIGS. 6–8 are perspective views of different structures and frame assemblies formed from one of the frame assemblies of the present invention.

FIG. 6 illustrates another application or use for the frame assembly 22. The frame assembly 20*b* in FIG. 6 can be used to support an item 76 (e.g., picture frame) or other exhibit or indicia. The frame assembly 20*b* is the same as the frame assembly 22 or 22*a*, except that connectors 78 (such as ties, straps, or the like) are coupled to the frame member 22*b* and the item 76. For example, each connector 78 can be a tie that has one end tied to the frame member 22*b* and the opposing end tied to the item 76. As another example, one end of the connector 78 can be nailed to the frame member 22*b*, and the opposing end of the connector 78 tied to the item 76.

Figure 7:
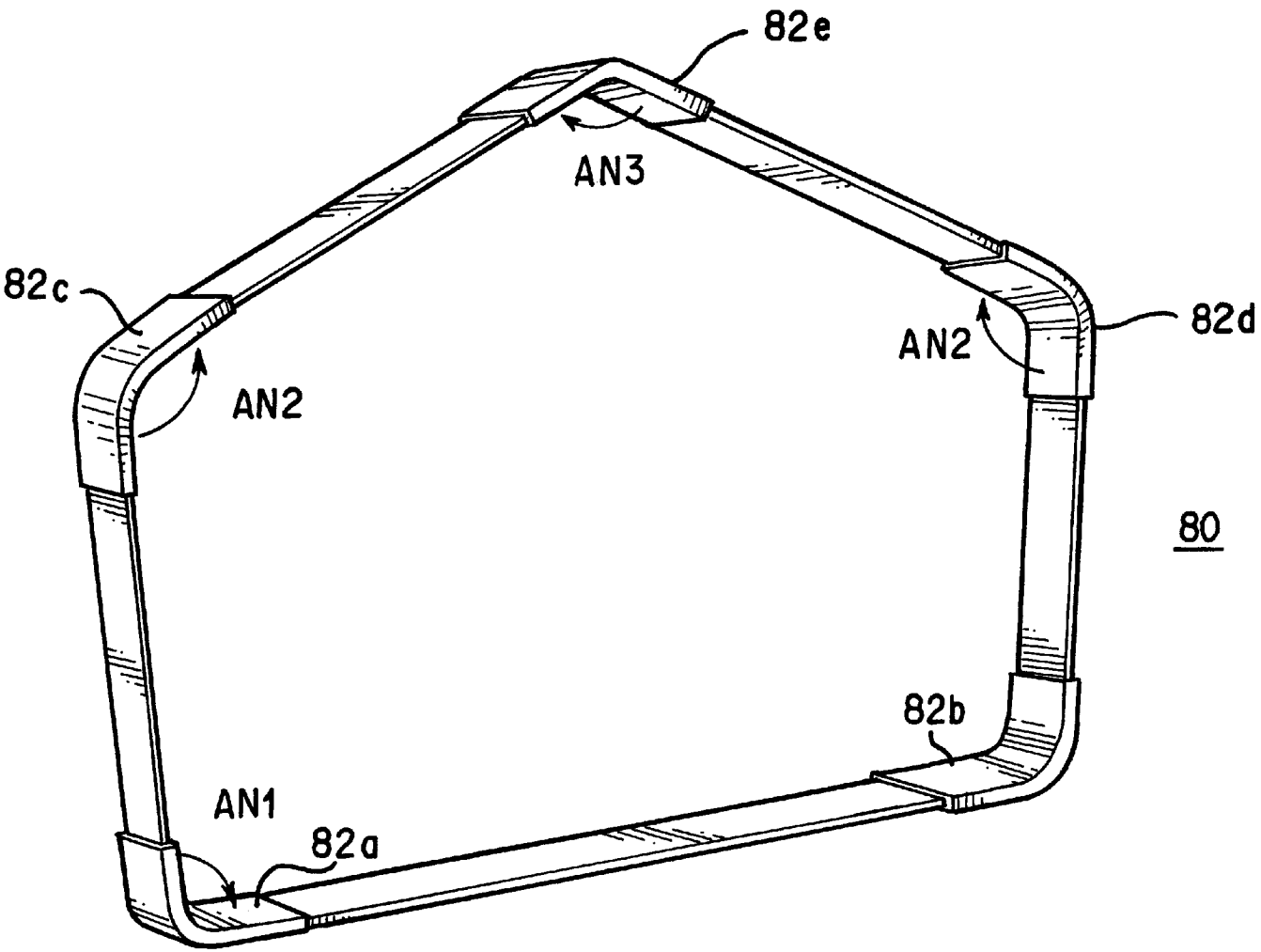

The shape of the frame assembly 20, 20*a* can also be varied. An example of a frame assembly that has a different shape is shown in FIG. 7, where the frame assembly 80 is essentially the same in construction as either the frame assembly 20 or 20*a*, except that frame assembly 80 has five sides. As a result, five sleeves 82 that are similar to sleeves 24 are provided to define the five-sided frame assembly 80. Each sleeve 82 is the same as sleeve 24, except that each is provided at a different angle to create the necessary configuration for the frame assembly 80. For example, the sleeves 82*a* and 82*b* are provided to be generally right-angled at AN1 (i.e., ninety degrees), while sleeves 82*c* and 82*d* define an angle (e.g., AN2) greater than ninety degrees, and sleeve 82*e* defines an angle (e.g., AN3) greater than angle AN2.

Figure 8:
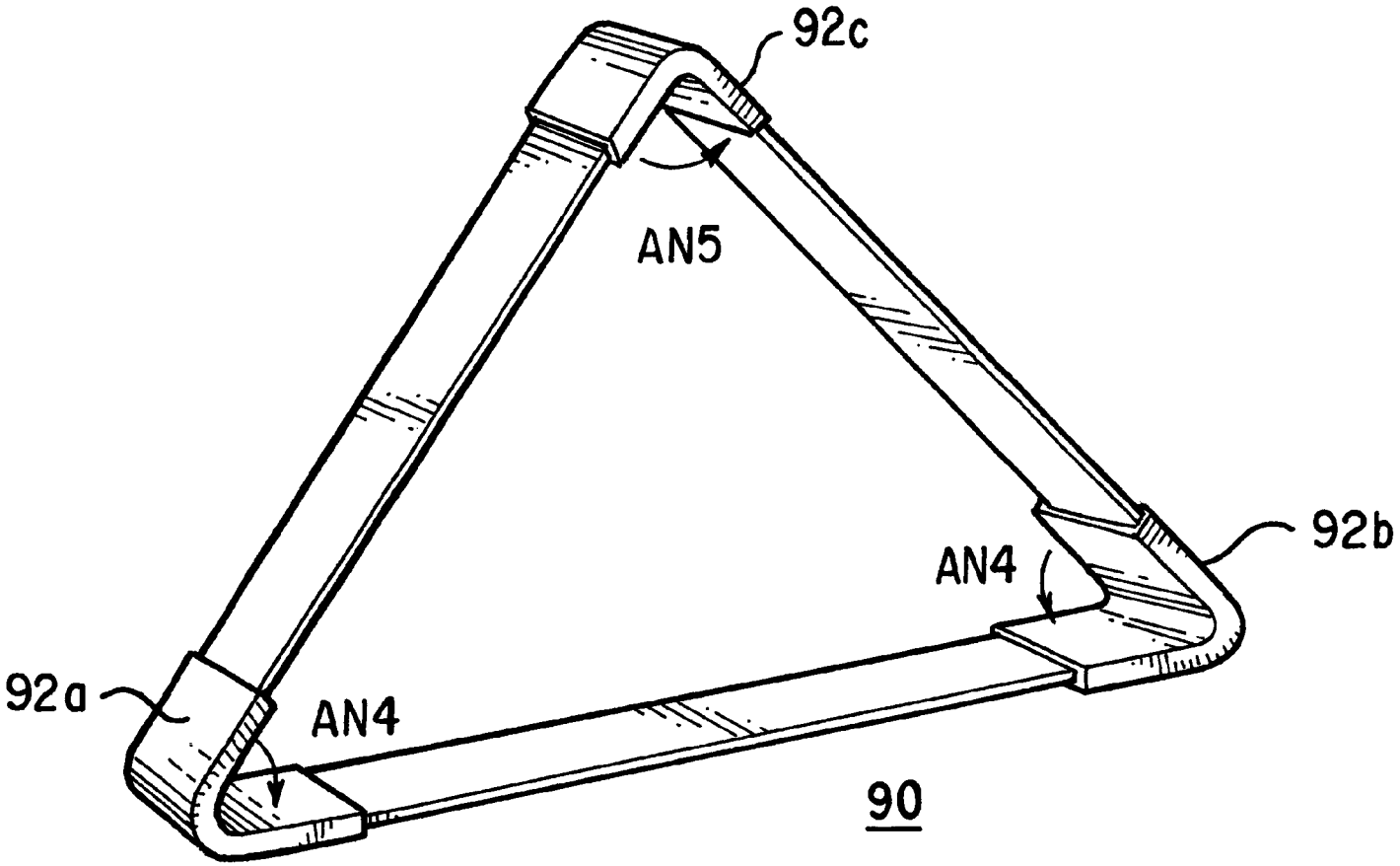

Another example of a frame assembly that has another different shape is shown in FIG. 8, where the frame assembly 90 is essentially the same in construction as either the frame assembly 20 or 20*a*, except that frame assembly 90 has three sides. As a result, three sleeves 92 that are similar to sleeves 24 are provided to define the three-sided frame assembly 90. Each sleeve 92 is the same as sleeve 24, except that each is provided at a different angle to create the necessary configuration for the frame assembly 90. For example, the sleeves 92*a* and 92*b* are provided at a first angle AN4, while sleeve 92*c* defines an angle (e.g., AN5) greater than angle AN4.

Figure 9:
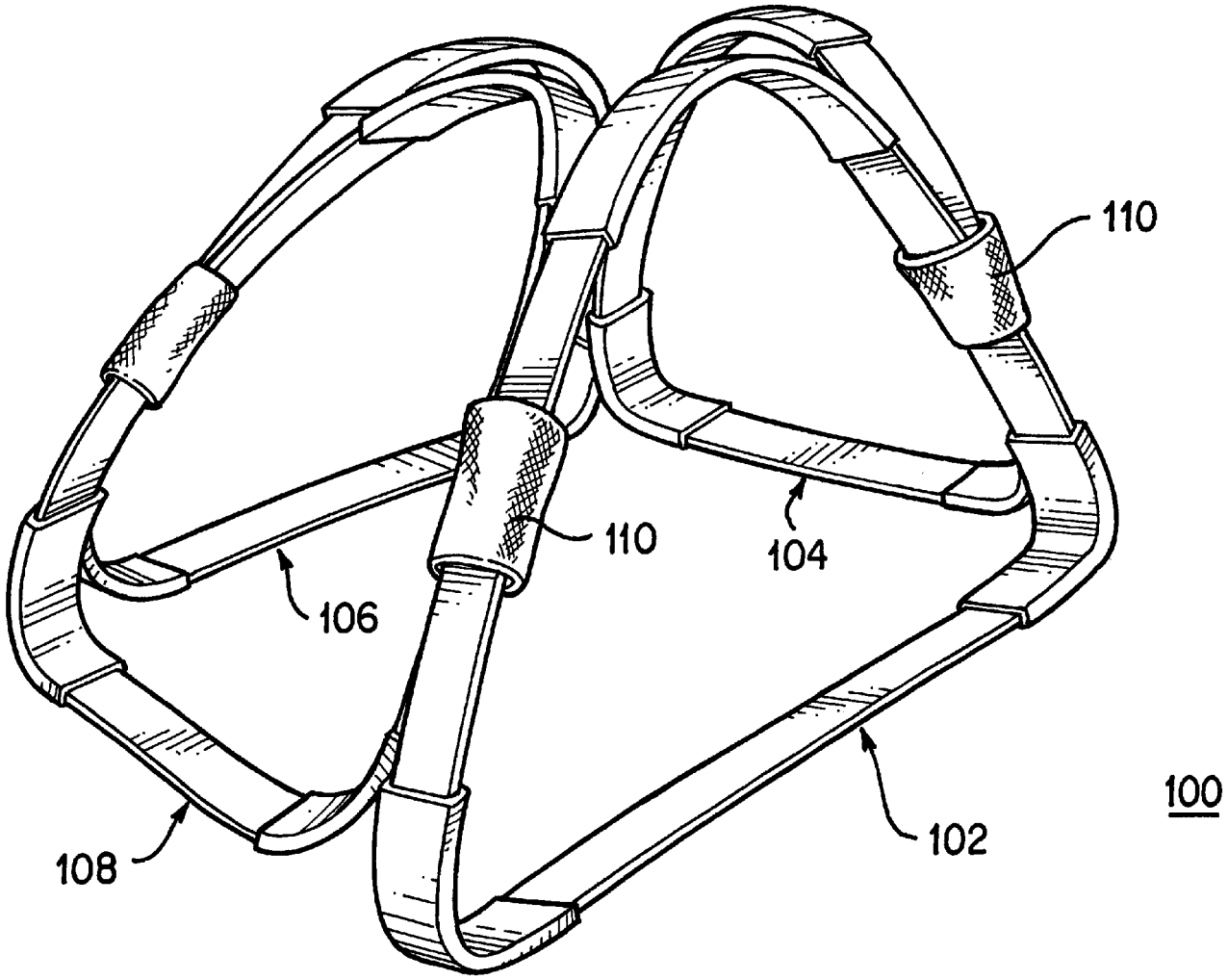
FIGS. 9–10 are perspective views of another structure formed from a plurality of the frame assemblies of the present invention.

FIG. 9 illustrates the use of four of the three-sided frame assemblies 90 to form a four-sided collapsible structure 100. The principles illustrated in connection with the structure 40 of FIG. 4A are applicable to the structure 100 of FIG. 9, the only difference being that the frame assemblies 90 in FIG. 9 have a different shape from the frame assemblies 20 in FIG. 4A. As with FIG. 4A, each frame assembly 90 defines a panel 102, 104, 106, 108, and fabric pieces 62 can be stitched to cover one or more of the panels 102, 104, 106, 108 defined by the frame assemblies 90. In addition, retaining sleeves 110 (which can be the same as retaining sleeves 60) can be used to hingedly couple adjacent frame assemblies 90. The structure 100 can be folded and collapsed using the same method illustrated above for structure 40.

Figure 10:
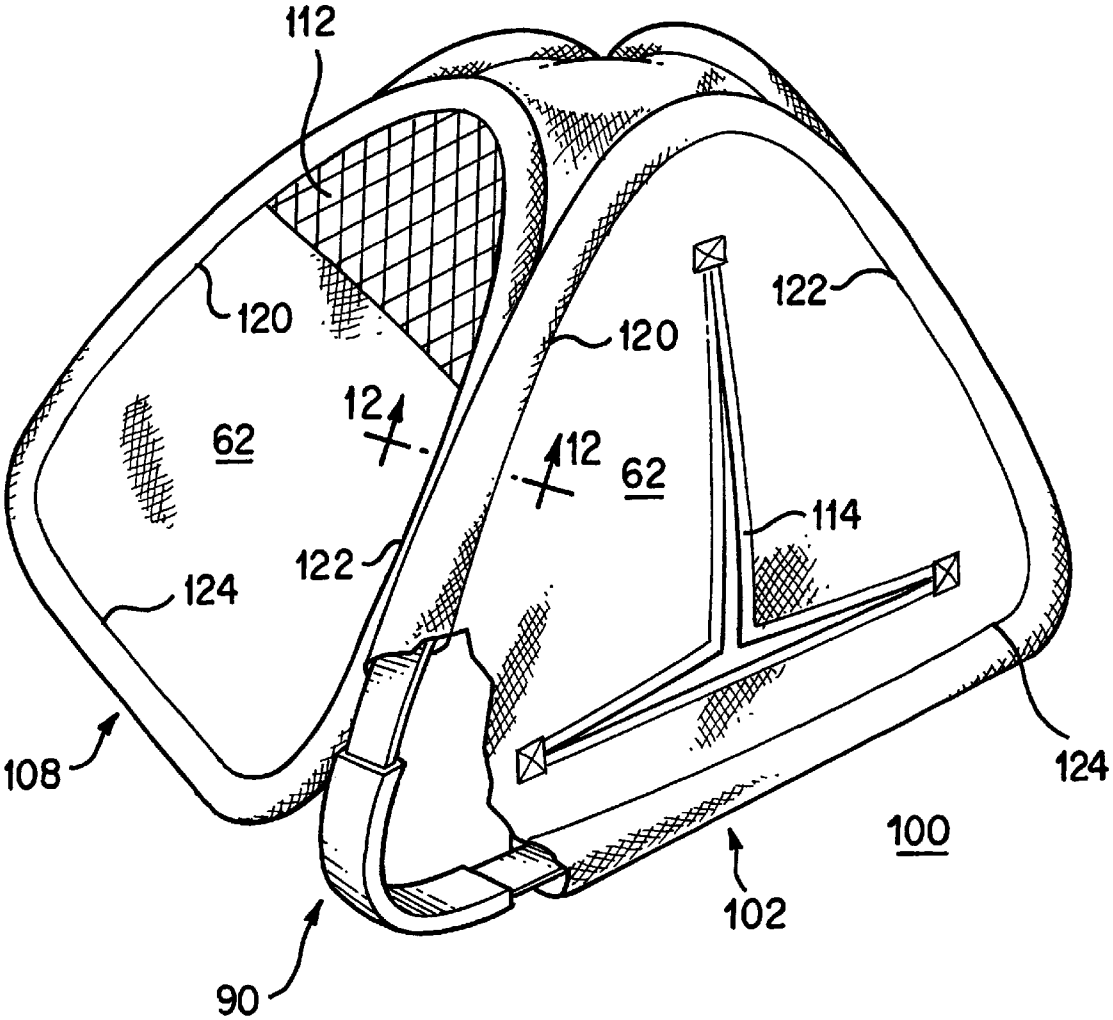

FIG. 10 illustrates the structure 100 of FIG. 9 with each panel 102, 104, 106, 108 partially or completely covered by fabric 62. For example, the fabric 62 that extends across panel 108 can have a meshed portion 112, while the fabric 62 that extends across panel 102 can have slits 114 that are used to define a door. Therefore, the structure 100 as illustrated in FIG. 10 can be used as a tent or shelter. The fabric 62 can be attached to the frame members of the frame assemblies 90 using the principles illustrated in FIG. 11.

Figure 12:
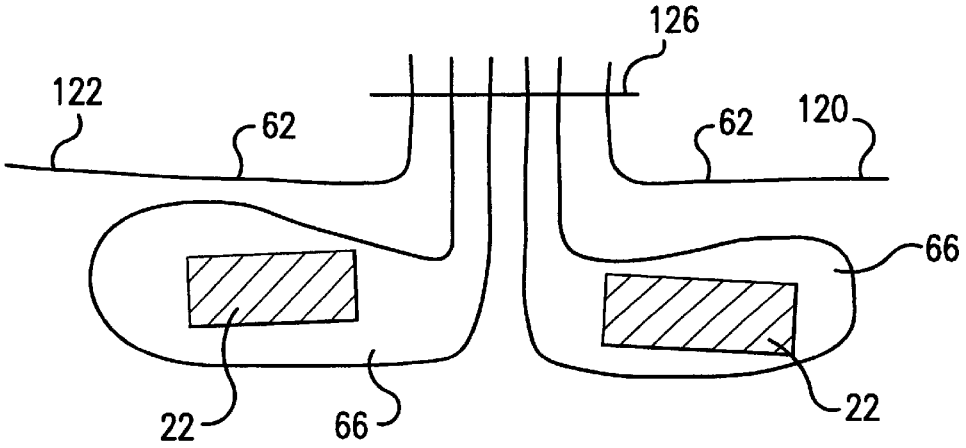
FIG. 12 is a cross-sectional view of a connection between two adjacent panels of the structure of FIG. 10 taken along line 12—12 thereof.

In addition, the retaining sleeves 110 can be omitted in FIG. 10. Instead of providing the retaining sleeves 110 to couple and hinge the sides of adjacent panels, it is possible to stitch the sides of adjacent panels to form a hinged connection. In particular, the right side 122 of each panel can be stitched to the left side 120 of each panel. For example, FIG. 12 illustrates one method for hingedly connecting the right side 122 of panel 108 and the left side 120 of panel 102. The fabric pieces 62 for each panel 102 and 108 are folded over at their edges along the bottom side 124 to define the respective peripheral sleeves 66 in the manner described in connection with FIG. 11. The fabric pieces 62 are stitched at their edges by a stitching 126 to the respective peripheral sleeves 66. The stitching 126 also acts as a hinge for the panels 102 and 108 to be folded upon each other. The same hinge structure can be used for hingedly connecting the right sides 122 and the left side 120 of the other adjacent panels.

The structures 40 and 100 can be used in the same applications as those similar structures described in U.S. Pat. Nos. 5,301,705 and 5,560,385. Thus, the frame assemblies of the present invention provide the flexibility of forming panels and structures having a variety of different shapes, thereby increasing the applications and use of the resulting collapsible structures to provide the user with an unlimited source and variety of fun and entertainment.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible frame assembly, comprising:

a coilable and continuous frame member having a folded and an unfolded orientation, wherein the frame member may be twisted and folded to form a plurality of concentric loops in the folded orientation to reduce the size of the frame assembly; and a plurality of corner sleeves, each corner sleeve having a lumen for retaining a selected portion of the frame member, the plurality of corner sleeves positioned in spaced apart relation along the frame member to form a bend at each location of a corner sleeve.

2. The assembly of claim 1, wherein each corner sleeve defines an angle.

3. The assembly of claim 1, further including a fabric material covering selected portions of the frame member to form a panel when the frame member is in the unfolded orientation, the fabric assuming the unfolded orientation of the frame member.

4. The assembly of claim 3, further including a peripheral sleeve for retaining the frame member and the corner sleeves.

5. The assembly of claim 1, wherein each bend forms two sides for the frame member.

6. The structure of claim 1, wherein each bend forms two sides for the frame member.

7. A collapsible structure, comprising:

a first frame assembly and a second frame assembly, each frame assembly having:

(a) a coilable and continuous frame member having a folded and an unfolded orientation, wherein the frame member may be twisted and folded to form a plurality of concentric loops in the folded orientation to reduce the size of the frame assembly;

(b) a plurality of corner sleeves, each corner sleeve having a lumen for retaining a selected portion of the frame member, the plurality of corner sleeves positioned in spaced apart relation along the frame member to form a bend at each location of a corner sleeve; and (c) a left side and a right side;

wherein the right side of the first frame assembly is hingedly coupled to the left side of the second frame assembly.

8. The structure of claim 7, further including a retaining sleeve having a lumen for retaining a part of the first and second frame assemblies.

9. A collapsible structure, comprising:

at least three frame assemblies, each having:

(a) a coilable and continuous frame member having a folded and an unfolded orientation, wherein the frame member may be twisted and folded to form a plurality of concentric loops in the folded orientation to reduce the size of the frame assembly;

(b) a plurality of corner sleeves, each corner sleeve having a lumen for retaining a selected portion of the frame member, the plurality of corner sleeves positioned in spaced apart relation along the frame member to form a bend at each location of a corner sleeve; and (c) a left side and a right side;

wherein the left side of each frame assembly is hingedly coupled to the right side of an adjacent frame assembly to form a ring of frame assemblies.

10. The structure of claim 9, further including a retaining sleeve having a lumen for retaining a part of two adjacent frame assemblies.

11. The structure of claim 9, wherein each corner sleeve defines an angle.

12. The structure of claim 9, wherein each frame assembly further includes a fabric material covering selected portions of the corresponding frame member to form a panel when the corresponding frame member is in the unfolded orientation, the fabric assuming the unfolded orientation of the corresponding frame member.

13. The structure of claim 12, wherein each frame assembly further includes a peripheral sleeve for retaining the corresponding frame member and the corner sleeves.

14. The structure of claim 9, further including a fabric covering that surrounds the ring of frame assemblies.

15. The structure of claim 9, wherein each bend forms two sides for the frame member.

* * * * *